US008558708B2

(12) United States Patent
Albert et al.

(10) Patent No.: US 8,558,708 B2
(45) **Date of Patent: *Oct. 15, 2013**

(54) SUPPLEMENTAL ALERT GENERATION DEVICE WITH SPEAKER ENCLOSURE ASSEMBLY

(75) Inventors: David E. Albert, Oklahoma City, OK (US); James J. Lewis, Oklahoma City, OK (US); Landgrave T. Smith, Oklahoma City, OK (US)

(73) Assignee: InnovAlarm Corporation, Oklahoma City, OK (US)

( * ) Notice: Subject to any disclaimer, the term of this patent is extended or adjusted under 35 U.S.C. 154(b) by 265 days.

This patent is subject to a terminal disclaimer.

(21) Appl. No.: 12/703,081

(22) Filed: Feb. 9, 2010

(65) Prior Publication Data

US 2011/0193713 A1 Aug. 11, 2011

(51) Int. Cl.
*G08B 25/08* (2006.01)

(52) U.S. Cl.
USPC ..... 340/635; 340/521; 181/151

(58) Field of Classification Search
USPC ..... 340/521, 600, 384.4, 628, 539.3, 540, 340/531, 407.1, 635; 381/73.1, 315; 362/475; 181/151, 153; 330/41, 2
See application file for complete search history.

(56) References Cited

U.S. PATENT DOCUMENTS

| | | | | |
|---|---|---|---|---|
| 4,282,520 | A | 8/1981 | Shipp et al. | |
| 4,417,235 | A | 11/1983 | Del Grande | |
| 4,474,258 | A * | 10/1984 | Westlund | 181/151 |
| 5,191,636 | A | 3/1993 | Halperin | |
| 5,254,897 | A | 10/1993 | Miller et al. | |
| 5,594,422 | A | 1/1997 | Huey, Jr. et al. | |
| 5,625,338 | A | 4/1997 | Pildner et al. | |
| 5,710,395 | A * | 1/1998 | Wilke | 181/153 |
| 5,990,797 | A | 11/1999 | Zlotchenko et al. | |
| 6,150,943 | A * | 11/2000 | Lehman et al. | 340/628 |
| 6,404,655 | B1 * | 6/2002 | Welches | 363/41 |
| 6,646,548 | B2 * | 11/2003 | Dornfeld | 340/384.4 |
| 6,658,123 | B1 * | 12/2003 | Crutcher | 381/315 |
| 6,744,310 | B2 * | 6/2004 | Honda | 330/2 |
| 7,015,807 | B2 * | 3/2006 | Roby et al. | 340/531 |

(Continued)

OTHER PUBLICATIONS

International Search Report in counterpart PCT Appl. No. PCT/US2011/022782.

(Continued)

*Primary Examiner* — Steven Lim
*Assistant Examiner* — Kaleria Knox
(74) *Attorney, Agent, or Firm* — Knobbe, Martens, Olson & Bear, LLP

(57) ABSTRACT

A battery-powered supplemental alert generator is disclosed that is adapted to be mounted in close proximity to, such as within 3 or 4 feet of, a conventional smoke, heat and/or fire detector/alert device. The supplemental alert generator operates in a relatively low power mode while listening for the nearby detector/alert device to generate a standard audible alert signal. Upon detecting that a monitored sound level has reached a particular threshold, the supplemental alert generator enters into a higher power analysis mode in which it analyzes the detected signal to assess whether it is an audible alert signal. If an audible alert signal is detected, the supplemental alert generator generates one or more supplemental alert signals, such as a 520 Hz audible square wave signal. The supplemental alert generator may be used to retrofit a house, hotel, or other building to comply with new standards or to otherwise increase the effectiveness of the existing detection/alert system.

44 Claims, 7 Drawing Sheets

(56) References Cited

U.S. PATENT DOCUMENTS

| | | | | |
|---|---|---|---|---|
| 7,170,397 | B2 | 1/2007 | Roby et al. | |
| 7,170,404 | B2 * | 1/2007 | Albert et al. | 340/521 |
| 7,477,143 | B2 | 1/2009 | Albert | |
| 7,501,958 | B2 | 3/2009 | Saltzstein et al. | |
| 7,522,035 | B2 | 4/2009 | Albert | |
| 7,551,170 | B2 | 6/2009 | Eaton | |
| 7,656,287 | B2 | 2/2010 | Albert et al. | |
| 7,804,964 | B2 * | 9/2010 | Schreiber | 381/73.1 |
| 2004/0145467 | A1 * | 7/2004 | Roby et al. | 340/531 |
| 2005/0128748 | A1 | 6/2005 | Suwa | |
| 2005/0190067 | A1 * | 9/2005 | Black et al. | 340/628 |
| 2006/0139153 | A1 | 6/2006 | Adelman | |
| 2007/0001825 | A1 * | 1/2007 | Roby et al. | 340/407.1 |
| 2007/0070638 | A1 * | 3/2007 | Fukawa et al. | 362/475 |
| 2007/0146127 | A1 * | 6/2007 | Stilp et al. | 340/531 |
| 2007/0165872 | A1 | 7/2007 | Bridger et al. | |
| 2008/0012716 | A1 * | 1/2008 | Saltzstein et al. | 340/600 |
| 2008/0266121 | A1 | 10/2008 | Ellul | |
| 2009/0207029 | A1 | 8/2009 | Shah et al. | |

OTHER PUBLICATIONS

International Preliminary Report on Patentability issued on May 31, 2012 in PCT application No. PCT/US11/22782.

* cited by examiner

SUPPLEMENTAL ALERT GENERATION DEVICE WITH SPEAKER ENCLOSURE ASSEMBLY

BACKGROUND

1. Technical Field

The present disclosure relates to supplemental alert generation devices for supplementing the audible alert signals generated by smoke, fire, and/or carbon monoxide detectors.

2. Description of the Related Art

A variety of commercially available detector/alert devices exist for alerting individuals of the presence of smoke, heat, and/or carbon monoxide. These devices are typically designed to be mounted to the ceiling in various rooms of a house or other building, and are ordinarily powered by the building's AC power lines with battery backup. The audible alert signals generated by such devices are governed by various regulations such as Underwriters Laboratories (UL) 217 ("The Standard of Safety for Single and Multiple Station Smoke Alarms"), UL 464 ("The Standard of Safety for Audible Signal Appliances"), UL 1971 ("The Standard for Signaling Devices for the Hearing Impaired"), and UL 2034 ("The Standard of Safety for Single and Multiple Station Carbon Monoxide Alarms").

Typical smoke, fire, and carbon monoxide detectors produce a 3100-3200 Hz pure tone alert signal with the intensity (or power) of 45 to 120 dB (A-weighted for human hearing). The alert signals typically have either a temporal-three (T3) pattern or a temporal-four (T4) pattern. A T3 pattern has three half-second beeps separated by half-second pauses (periods of silence), followed by a 1.5 second pause after the third beep. A T4 pattern, which is commonly used for carbon monoxide detection, has four 0.1-seconds beeps separated by 0.1-seconds pauses, followed by five seconds of silence before the next sequence of four pulses begins.

Studies have shown that the 3100-3200 Hz alert signals generated by existing detector/alert devices are sometimes inadequate for alerting certain classes of individuals. These include children, heavy sleepers, and the hearing impaired. Consequently, commercially available products exists that are capable of listening for a T3 or T4 alert signal, and for generating a supplemental alert signal when a T3 or T4 signal is present. The supplemental alert signal may, for example, include a relatively low frequency audible signal in the range of 400 to 700 Hz, a strobe or other visual signal, or a bed vibration signal. One example of such a product is the Lifetone HL™ Bedside Fire Alarm and Clock available from Lifetone Technology. In addition, new regulations are being considered that would require commercially available detector/alert devices to generate a lower frequency audible alert signal, such as a 520 Hz square wave signal.

SUMMARY OF THE DISCLOSURE

A battery-powered supplemental alert generation device ("supplemental alert generator") is disclosed that is adapted to be mounted in close proximity to, such as within 3 or 4 feet of, a conventional smoke, heat and/or carbon monoxide detector/alert device. The supplemental alert generator preferably operates in a relatively low power "threshold monitoring" mode in which it monitors the sound level or intensity of detected sounds. Upon detecting that the monitored sound level has reached a particular threshold level or intensity, the supplemental alert generator enters into a higher power "analysis" mode in which it analyzes the detected signal to assess whether it is a T3, T4, or other standard audible alert signal. If this analysis reveals the presence of a standard audible alert signal, the supplemental alert generator generates one or more supplemental alert signals, such as a 520 Hz square wave audio signal, an audible alert signal having other characteristics, and/or a strobe light signal.

Because the supplement alert generator is designed to be mounted near the conventional detector/alert device, a relatively high sound-level threshold (e.g., between 70 and 90 decibels) can be used to trigger transitions into the analysis mode. As a result, the supplemental alert generator typically remains in its low power "threshold monitoring" state except when the nearby detector/alert device generates an audible alert signal. In some embodiments, the battery drain when operating in the low-power listening mode is sufficiently low to enable the supplemental alert generator to operate for several years using two AA alkaline batteries or a similar battery source (e.g., four AA batteries, a C-cell battery, or a CR123 lithium battery).

The supplemental alert generator can be used to retrofit a house, hotel, or other building to comply with new standards or to otherwise increase the effectiveness of the preexisting detection/alert system. For example, supplemental alert generators can be mounted to the ceiling next to each preexisting smoke, heat and/or carbon monoxide detector. The cost of retrofitting an existing building in this manner can be significantly less than the cost of replacing the existing alert/detector devices.

In some embodiments, the supplemental alert generator may include additional inventive features for improving battery performance. For example, in some embodiments, a piezoelectric sensor is used to listen for the alert signal of the nearby detection/alert device. Because piezoelectric sensors are passive, the use of such a sensor reduces energy consumption in comparison to a microphone. As another example, the supplemental alert generator may implement a "learning" or "training" algorithm for learning the sound level and/or other characteristics of the monitored detection/alert device's alert signal.

Neither this summary nor the following detailed description purports to define or limit the scope of protection. The scope of protection is defined by the claims.

BRIEF DESCRIPTION OF THE DRAWINGS

These and other features will now be described with reference to the drawings summarized below. These drawings and the associated description are provided to illustrate specific embodiments, and not to limit the scope of protection.

DETAILED DESCRIPTION OF SPECIFIC EMBODIMENTS

A supplemental alert generation device that embodies various inventions will now be described with reference to the drawings. As will be recognized, some of the inventive features of the device may be implemented without others, and/or may be implemented differently than described herein. Thus, nothing in this detailed description is intended to imply that any particular feature, characteristic, or component of the disclosed device is essential.

I. Overview (FIG. 1)

Figure 1:
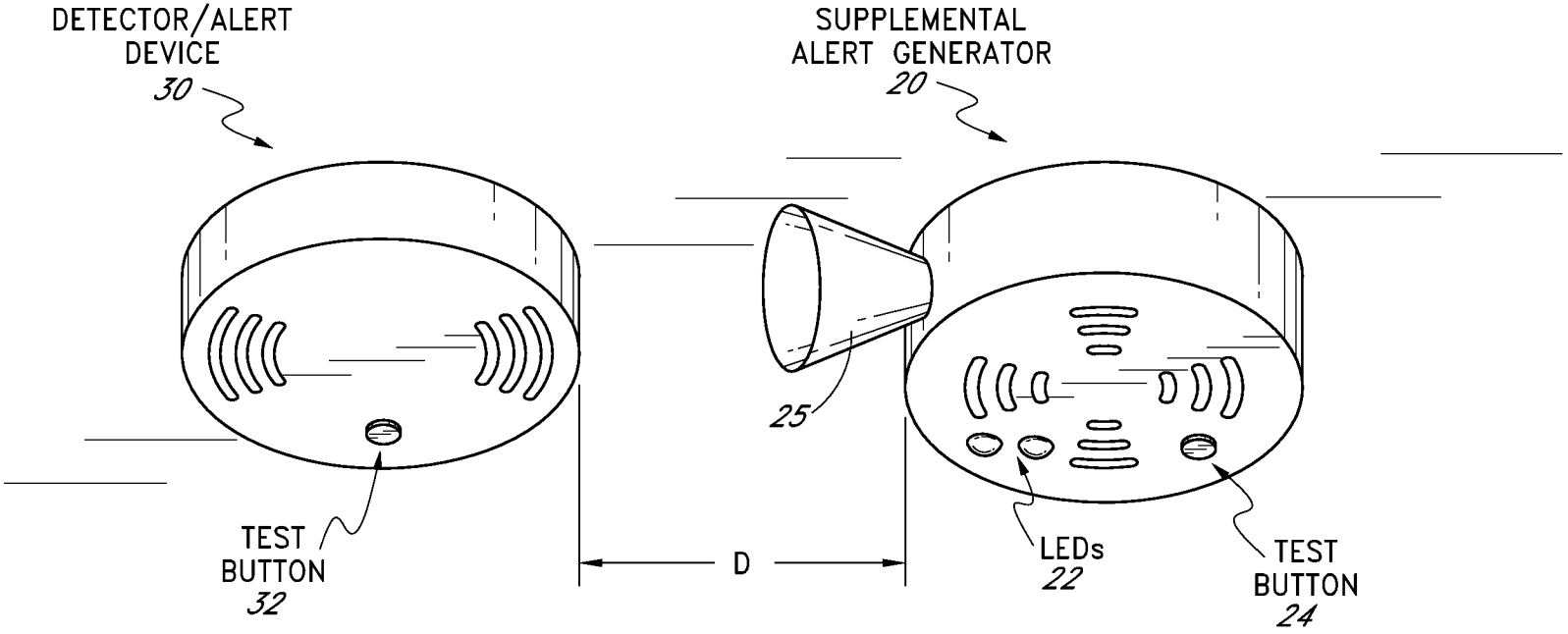
FIG. 1 illustrates a supplemental alert generation device ("supplemental alert generator") mounted to the ceiling next to an detector/alert device that it monitors.

FIG. 1 illustrates a supplemental alert generator 20 according to one embodiment. The supplemental alert generator 20 is shown mounted to the ceiling of a building within a predefined distance D (e.g., 2, 3 or 4 feet) of a previously installed ceiling-mounted detector/alert device 30. The detector/alert device 30 may be a conventional, commercially-available, AC-powered device capable of detecting smoke, heat, carbon monoxide, or a combination thereof. As explained above, the previously installed detector/alert device 30 typically generates a T3 or T4 audible alert or "beep" signal in the 3100-3200 Hz range. Other types of audible alert signals may be used, particularly outside the United States.

The supplemental alert generator 20 is a battery-powered device (i.e., it is not connected to an AC power source) that is designed to continuously listen for the alert signal of the detector/alert device 30. When the alert signal is detected, the supplemental alert generator 20 generates one or more supplemental alert signals. In the embodiments shown in the drawings, the supplemental alert generator 20 generates a relatively low frequency audible alert signal, such as a 520 Hz square wave signal, that is more effective at alerting the hearing impaired, deep sleepers, and children. This supplemental alert signal preferably has an average decibel level (dBA) of 85 or higher as measured ten feet from the device 20, as specified by existing standards and regulations. The device 20 may additionally or alternatively be designed to generate other types of supplemental alerts, such as a strobe light signal, an audible signal whose frequency content varies over time, and/or a wireless (RF) transmission to a separate alert device or system.

In the particular embodiment shown in FIG. 1, the supplemental alert generator 20 has approximately the same size and shape as the conventional detector/alert device 30. However, this need not be the case. For example, the supplemental alert generator 20 may be larger or smaller in size than the detector/alert device 30, and may have a different configuration. In addition, although shown mounted to the ceiling, the supplemental alert generator 20 can alternatively be mounted to a wall.

The supplemental alert generator 20 may be used to retrofit an existing home, hotel, office building, or other facility to comply with new regulations or to otherwise increase the effectiveness of the existing detection/alert system. This may be done by, for example, mounting one supplemental alert generator 20 next to each respective preexisting detector/alert device 20. Typically, the cost of retrofitting a facility in this manner will be significantly less than the cost of replacing all of the existing detector/alert devices 30. This cost savings can be achieved primarily because the supplemental alert generator 20 preferably (1) does not itself include any circuitry or components for detecting smoke, heat or carbon monoxide, (2) can be constructed from low cost components, and (3) does not connect to an AC power source.

The supplemental alert generator 30 preferably operates primarily in a relatively low power "threshold monitoring" mode in which it listens for sounds of sufficiently high sound level or intensity to represent the alert signal of the nearby detector/alert device 20. When operating in this mode, the supplemental alert generator 30 preferably does not analyze audio signals it hears to determine whether such signals match the expected T3, T4 or other standard alert signal pattern. For example, in one embodiment, no analysis of signal pulse lengths, pulse periodicity, or other timing parameters is performed, and no active components are used to filter the received audio signal. This enables the device 30 to operate at a very low power level the vast majority of the time. As a result, assuming supplemental alerts are generated very infrequently, the supplemental alert generator 30 can typically operate for several years without replacing the battery or batteries. In addition, because no pattern analysis is performed unless a high volume sound is detected, false positives are generally less likely to occur (in comparison to products that analyze the signal continuously).

When the supplemental alert generator 30 detects a sound of sufficient volume, it enters into a higher power mode in which it analyzes the received audio signal. To implement this feature, the supplemental alert generator 30 preferably uses a signal comparator to determine whether the magnitude or intensity of the received audio signal exceeds a particular threshold. This threshold may be fixed. Preferably, however, the threshold is adjustable such that the supplemental alert generator 20 can be calibrated or tuned based on the characteristics of the detector/alert device 30 with which it is paired.

In one embodiment, the supplemental alert generator 20 can be placed into a "learn" mode in which it listens to the detector/alert device's alert signal (which is generated when the device's standard test button 32 is pressed), and tunes itself accordingly. The tuning process may include or consist of selecting and setting a threshold level to be used for subsequent threshold monitoring. The learning process is preferably performed after the supplemental alert generator 20 has been mounted, so that the selected threshold reflects the actual distance D between the two devices.

During the learning process, the supplemental alert generator may additionally or alternatively select or adjust one or parameters of a signal analysis algorithm. For instance, the supplemental alert generator 20 may measure one or more timing parameters (pulse width, pulse separation, etc.) of the alert signal for subsequent use during alert signal verification. As another example, the supplemental alert generator 20 may be capable of detecting that the adjacent detector/alert device generates a non-T3, non-T4 alert signal (as may be the case outside the US), and may be capable of adapting/adjusting its signal analysis algorithm to permit subsequent detection of this signal.

As illustrated in FIG. 1, the supplemental alert generator 20 may include one or more LEDs 22, such as a red LED and a green LED, that serve similar functions to those of conventional detector/alert devices 30. In addition, the supplemental alert generator 20 may include a test button 24 that can be depressed to cause the device to generate its supplemental alert signal(s).

In the embodiment shown in FIG. 1, the supplemental alert generator 20 also includes a conical acoustic coupler 25 that acts both as a passive amplifier and a filter. Where such a coupler 25 is provided, the supplemental alert generator 20 is preferably mounted such that the coupler 25 extends outward in the direction of the monitored detector/alert device 30. The coupler 25 may be composed of plastic or another suitable material, and may extend into the housing of the supplemental alert generator 20. In one implementation intended to improve detection of signals in the range of 2800 to 3400 Hz, the coupler's diameter is about 1.65 inches at the large opening. The small end of the conical acoustic coupler 25 may vary in size, depending on the size and type sound sensor used.

II. Block Diagram (FIG. 2)

Figure 2:
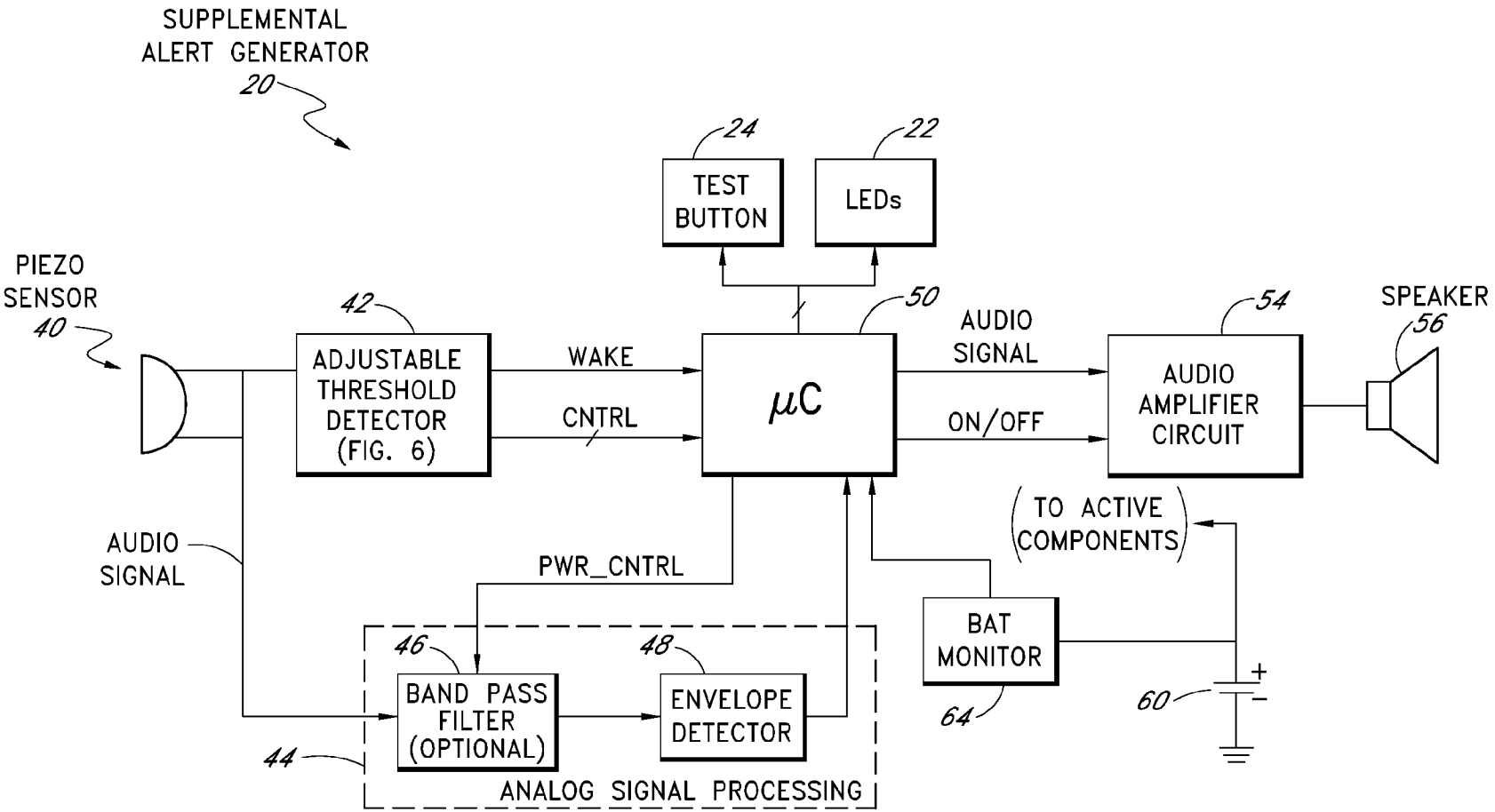
FIG. 2 is a block diagram of one embodiment of the supplemental alert generator.

FIG. 2 is a block diagram of one embodiment of the supplemental alert generator 20. In this embodiment, the supplemental alert generator 20 uses an audio speaker 56 to generate the supplemental alert signal. In other embodiments, the supplemental alert may be generated using a piezoelectric element, another type of sound generation device, a strobe light, a radio frequency transmitter, or another type of signal generator. Various combinations of these and other types of alert generation devices (e.g., a speaker combined with a strobe light) may be used. The overall operation of the supplemental alert generator 20 is controlled by a controller 50, which is a programmed microcontroller in the illustrated embodiment.

In the embodiment shown in FIG. 2, the supplemental alert generator 20 includes a piezoelectric sensor 40 that passively converts sound energy into an electrical signal. A piezoelectric ceramic disk having a resonant frequency in the range of about 2900 to 3400 Hz, or more preferably 3000 to 3200 Hz, may be used for this purpose. (As discussed above, commercially-available detector/alert devices commonly produce alert signals in the 3100-3200 Hz range.) In one embodiment, the piezoelectric sensor 40 has a diameter of about 0.785 inches, and is mounted about 0.9 inches from, and in alignment with, the small opening of the conical acoustic coupler 25.

Unlike a microphone, the piezoelectric sensor 40 advantageously operates without consuming any power. Thus, the use of a piezoelectric sensor contributes to the low power consumption and long battery life of the supplemental alert generator 20. Another benefit is that piezoelectric sensors are not very sensitive in comparison to microphones, and are thus capable of effectively filtering out or ignoring relatively low volume sounds. Yet another benefit—particularly where the piezoelectric sensor's resonant frequency is matched to the tone frequency of the detector/alert device 30—is that relatively loud sounds falling substantially above or below the detector/alert device's tone frequency are effectively filtered out or ignored. Despite these benefits, a microphone or another type of non-piezoelectric sound sensor may alternatively be used in some embodiments.

As illustrated in FIG. 2, the audio signal generated by the piezoelectric sensor 40 is fed to an adjustable threshold detector 42. A non-adjustable threshold detector may alternatively be used. This audio signal is also passed to an analog signal processing circuit 44 that includes a band-pass filter 46 coupled to an envelope detector 48. As explained below, the band-pass filter 46 is maintained in an OFF state except when an audio signal of a sufficiently high volume is detected. The band-pass filter preferably has a center frequency of about 3000 to 3400 Hz, corresponding to the frequencies used by standard detector/alert devices. The band-pass filter 46 and/or the envelope detector 48 may alternatively be implemented in digital circuitry. As explained below, the band-pass filter 46 may be omitted in some embodiments.

Figure 6:
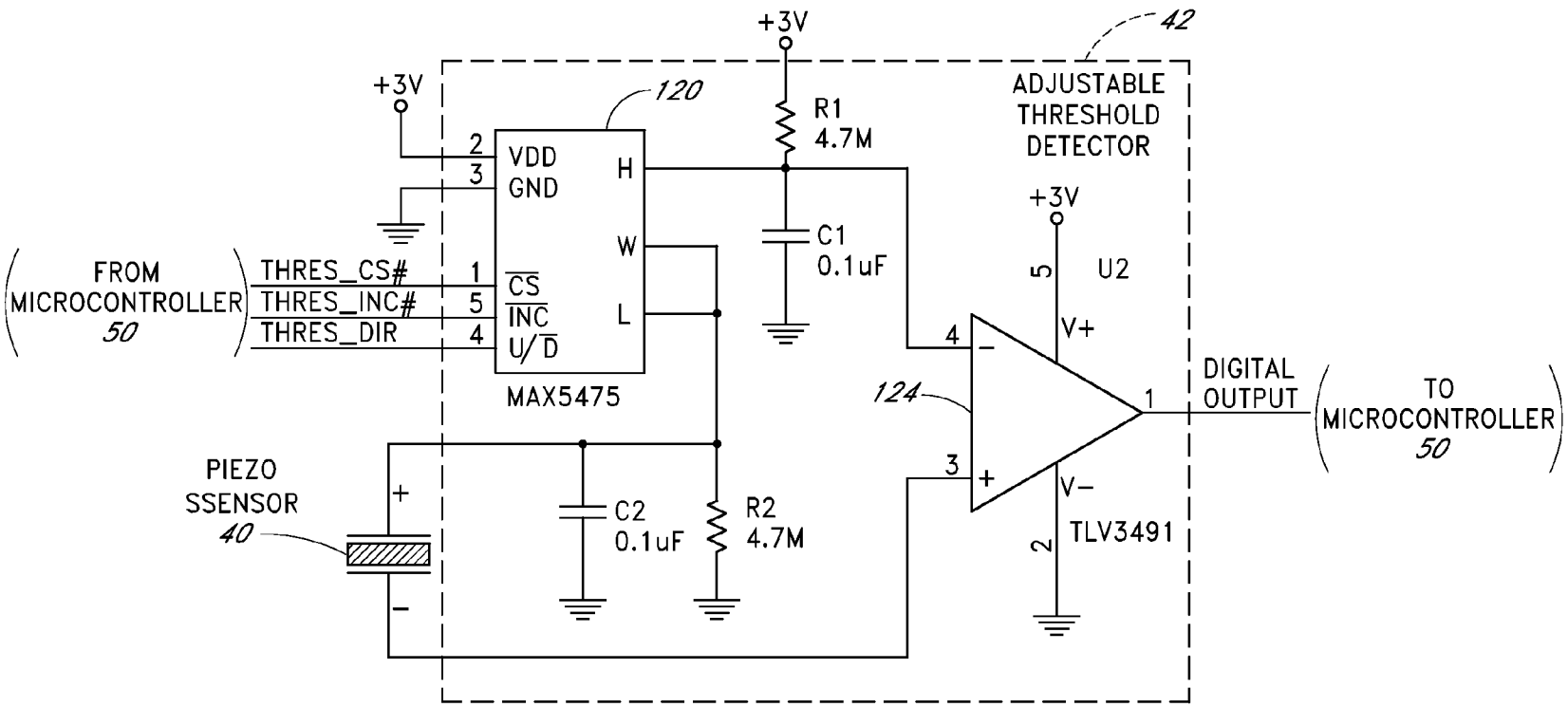
FIG. 6 illustrates one example of a circuit that may be used to implement the adjustable threshold detector of FIG. 2.

The threshold detector 42 is responsible for determining whether the audio signal exceeds the threshold level for triggering an analysis of the signal. One example of a circuit that may be used for this purpose is shown in FIG. 6 and is discussed below. When the threshold is met, meaning that a threshold level or higher of sound energy is present, the threshold detector 42 generates a notification signal to the microcontroller 50. In the illustrated embodiment, the notification signal is labeled WAKE to signify that it is capable of causing the microcontroller 50 to wake from its sleep state. As shown in FIG. 2, the microcontroller 50 is preferably capable of adjusting the threshold detector 42 via a set of control (CNTRL) lines to adjust the threshold sound level. Typically, the threshold is set to correspond to a sound level of about 70 to 90 dBA.

Upon being awoken by the threshold detector 42, the microcontroller 50 powers up the band-pass filter 46 (if one is provided) and begins analyzing the output of the envelope detector 48. When a T3 or T4 alert signal is present, this output signal (i.e., the output of the envelope detector 48) is a pulse signal whose pulses correspond in duration to the pulses/beeps of the alert signal. By analyzing the pulse durations, the separation between consecutive pulses, and/or other timing parameters of this signal, the microcontroller 50 can determine whether a T3 or T4 alert signal is present.

Because the piezoelectric sensor 40 acts as a band-pass filter to some extent, the band-pass filter 46 shown in FIG. 2 may be omitted in some embodiments. In these embodiments, the output of the piezoelectric sensor 40 is preferably connected as an input to both the envelope detector 48 and the microcontroller 50. This enables the microcontroller 50 to analyze the frequency of the received audio signal, and to also assess whether this audio signal has an ON/OFF pattern corresponding to a T3, T4, or other standard alarm signal.

In the illustrated embodiment, upon detecting a T3 or T4 signal, the microcontroller 50: (1) powers up an audio amplifier circuit 54 (as depicted by the signal line labeled ON/OFF in FIG. 2), and (2) generates, and outputs to the audio amplifier circuit, an audio alert signal. The audio alert signal may, for example be a square wave signal in the range of 400 to 700 Hz, such as a 520 Hz square wave signal. A variety of other types of audio alert signals may alternatively be used, including, for example, an audio signal whose fundamental frequency is ramped up or down over time. In addition, as described above, other types of supplemental alerts, including visual alerts, may additionally or alternatively be generated.

Where a square wave is used as the supplemental alert signal, the sound produced by the audio speaker 56 need not be that of a "true" or "perfect" square wave. For example, in the context of a 520 Hz square wave that supplements the approximately 3 kHz tone generated by existing smoke alarms, harmonics above about 2 kHz or 2.5 kHz are of little importance to the alarm signal's effectiveness. Thus, these frequency components can be omitted or attenuated.

In one embodiment, the audio amplifier circuit 54 comprises a Class D (non-linear) audio amplifier. In contrast to the efficiency range of Class A amplifiers that are commonly used in smoke and carbon monoxide alarms (30-35%), Class D amplifiers can achieve about 85 to 95% efficiency. Though common in portable audio applications such as portable MP3 players, Class D amplifiers are typically not used in alarm applications. The audio amplifier circuit 54 may also include a voltage boost regulator (not shown), such as a DC-to-DC converter, that boosts the voltage provided to the Class D amplifier to a level sufficient to produce the desired sound level (e.g., at least 85 dBA as measured 10 feet). The audio amplifier circuit 54 may, for example, be implemented using a model TPA2013 Class D audio amplifier with integrated voltage boost regulator from Texas Instruments (which may be powered by two AA batteries connected in series), or using a model no. LM48511 Class D audio amplifier with integrated voltage boost regulator from National Semiconductors (which may be powered by four AA batteries).

As shown in FIG. 2, the amplifier circuit 54 drives the audio speaker 56. The speaker 56 may, for example, be a conventional 3", 2.5" or 1" audio speaker. The speaker may, but need not, be mounted to a speaker enclosure (see FIG. 7, discussed below). In embodiments in which the supplemental alert is a square wave signal, the enclosure is preferably designed such that the object resonance of the speaker/enclosure combination is approximately the same as the fundamental frequency of the square wave. For example if the alert signal is a 520 Hz square wave, an enclosure that produces an object resonance of about 520 Hz is used. The use of such an enclosure tends to shift some of the higher frequency harmonics to the lower ones, primarily the first harmonic, compensating for the relatively poor performance of inexpensive audio speakers at relatively low frequencies. Examples of such enclosure designs, and of audio amplifier circuits 54 that may be used to drive the speaker 56, are described in commonly-owned U.S. patent application Ser. No. 12/702,822, filed Feb. 9, 2010, titled SPEAKER ENCLOSURE DESIGN FOR EFFICIENTLY GENERATING AN AUDIBLE ALERT SIGNAL, the disclosure of which is hereby incorporated by reference.

The microcontroller 50 is preferably a low power microcontroller or microprocessor device that is capable in being placed into one or more "sleep" or "low power" modes. The MSP430 family of microcontrollers available from Texas Instruments are suitable. A more powerful microcontroller, such as an ARM7 device, may alternatively be used. In some embodiments, the microcontroller 50 may be replaced with, or integrated into, an ASIC (application specific integrated circuit) or another type of IC device. The microcontroller 50 executes a firmware program for controlling the various functions of the supplemental signal generator 20. The flow charts shown in FIGS. 3-5 (discussed below) illustrate some of the program logic and functions that may be embodied in this firmware program. The firmware program may be stored in ROM, in flash memory, or on another suitable type of computer-readable storage medium or device. As will be apparent, another type of controller (e.g., a digital signal processor or an ASIC) can be used in place of the microcontroller 50.

As further illustrated in FIG. 2, the various active components of the supplemental alert generator 20 are powered by a battery 60, which may be formed from two or more batteries. In one embodiment, the battery 60 is implemented using two AA alkaline batteries connected in series (3V total). Other options include: three or four AA batteries, four AAA batteries, one or more C-cell or D-cell batteries, or a lithium CR123 battery. Further, a rechargeable battery may be used, in which case a solar cell may be provided to charge the battery 60. As illustrated, the microcontroller 50 may use a conventional battery monitoring circuit 64 to monitor the state of the battery 60.

Numerous variations to the block diagram of FIG. 2 are possible. As one example, a microphone may be provided that is powered up when a threshold sound level is detected. The signal generated by this microphone may then be analyzed (in additional to or instead of the piezoelectric sensor's signal) to assess T3/T4 compliance. As another example, a strobe light can be provided for generating a visual supplemental alert signal, and/or an RF transmitter can be provided for transmitting an alert message on a wireless network.

The various components shown in FIG. 2 may be housed within a plastic or other housing similar to that used for existing smoke alarms. An adhesive and/or screw holes may be provided for attaching the housing to the ceiling.

III. Program Logic (FIGS. 3 and 4)

Figure 3:
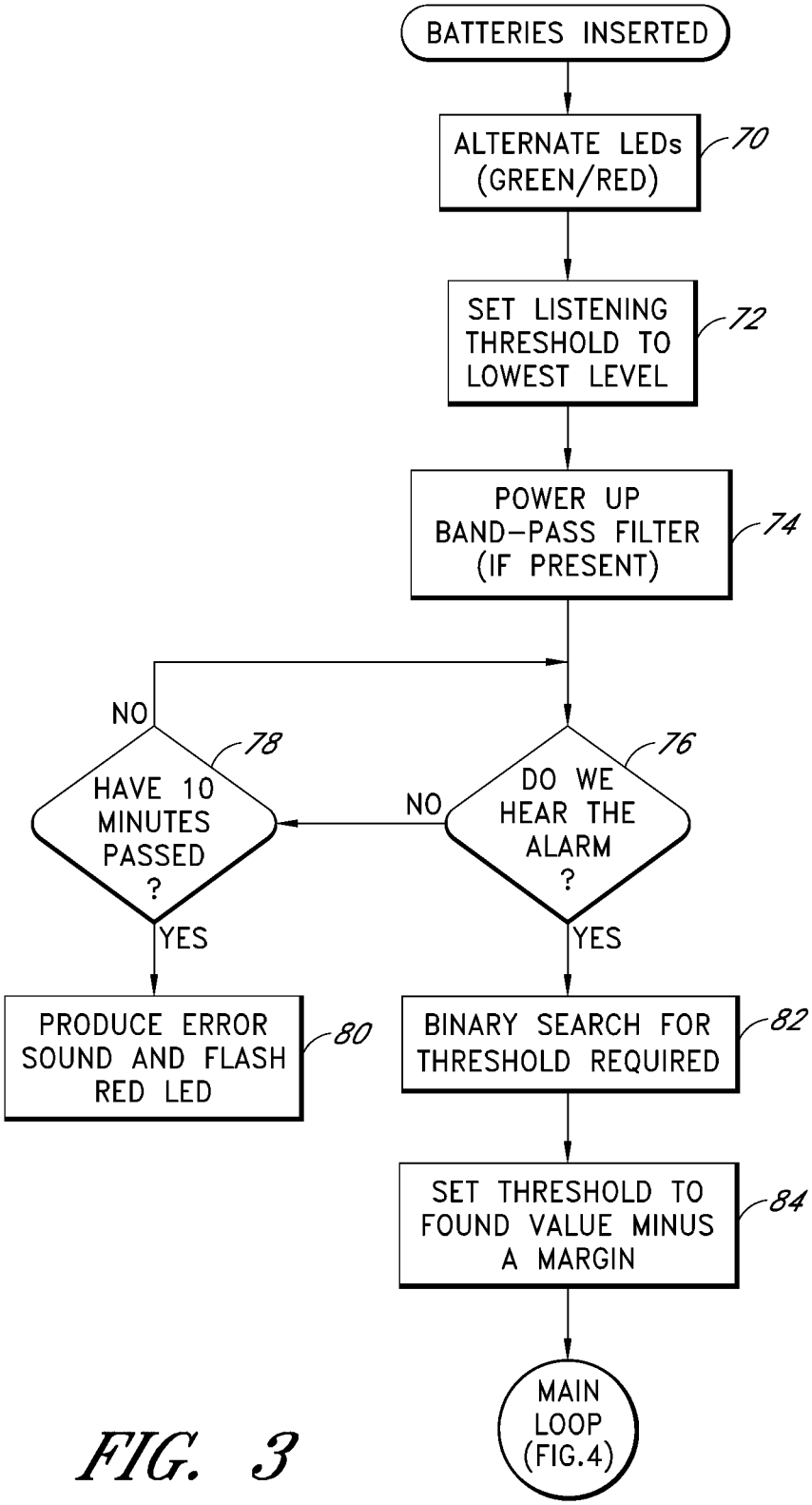
FIG. 3 illustrates an initialization and learning process executed by a controller/processor of the supplemental alert generator.
Figure 4:
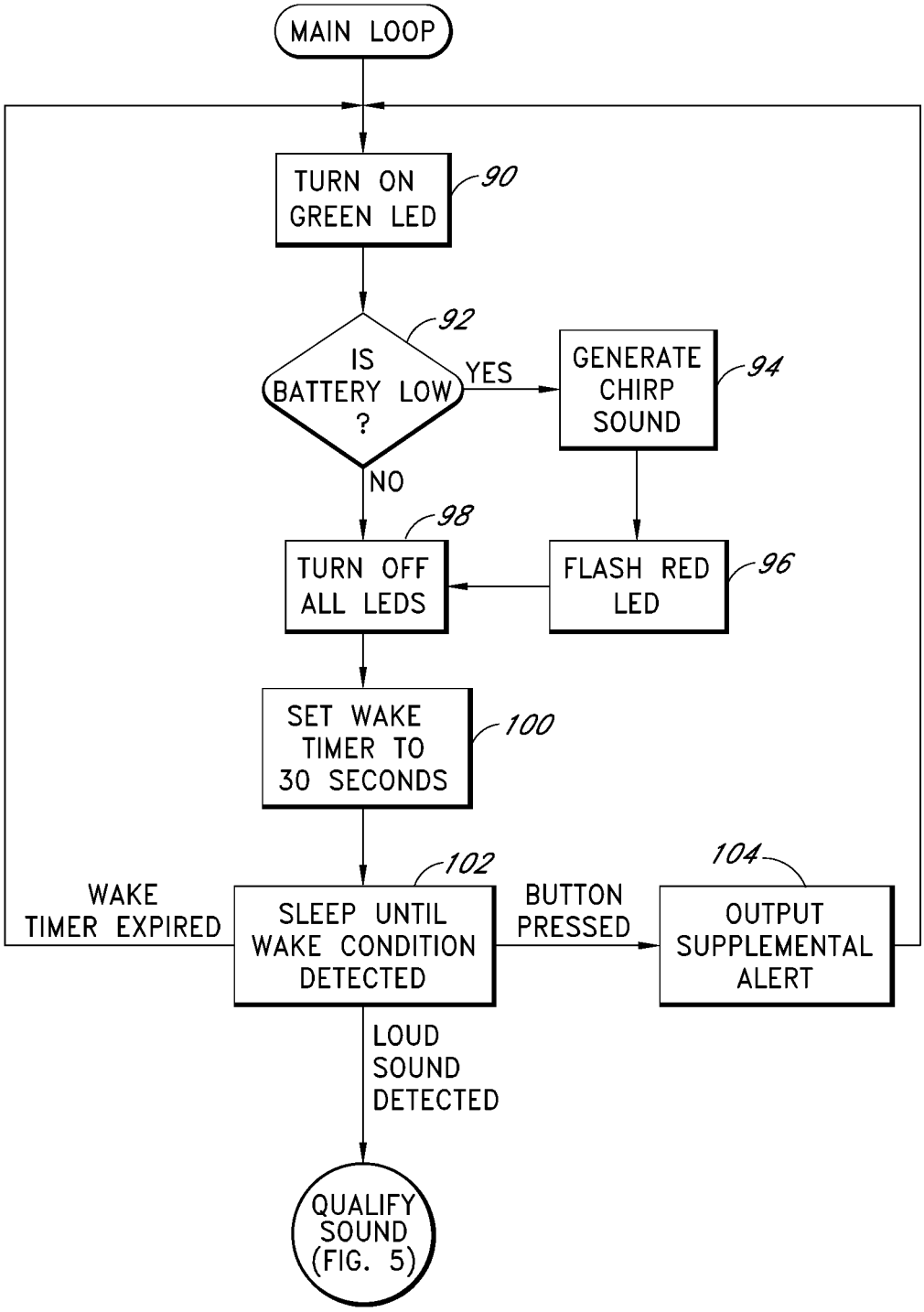
FIG. 4 illustrates a main program loop executed by the supplemental alert generator's controller.

FIGS. 3 and 4 illustrate some of the functions that may be embodied in the firmware program executed by microcontroller 50. Some or all of these functions may alternatively be implemented in application-specific circuitry (e.g., an ASIC, FPGA, or other device). As will be apparent, the program logic can be varied significantly from that shown in the drawings.

FIG. 3 illustrates an initialization or "learning" sequence that may be executed when the battery or batteries are inserted into the supplemental alert generator 20. This initialization process assumes the operator will depress the "test" button 32 on the adjacent detector/alert device 30 (to cause its alarm to sound) within a short time period after inserting the batteries. As depicted by blocks 70-74, the microcontroller 50 initially (1) alternates the green and red LEDs 22 to indicate that the device 20 is in its "learn" mode, (2) sets the listening threshold to its lowest level by controlling the adjustable threshold detector 42, and (3) turns on the band-pass filter 46 (if such a filter is provided). In some embodiments, the microcontroller 50 may also output, via the audio amplifier circuit 54 and speaker 56, a pre-recorded or synthesized voice message instructing the operator to press the test button 32. As represented by blocks 76 and 78, the microcontroller 50 then enters into a loop in which it listens for the alert signal of the adjacent detector/alert device 30. To determine whether an alert signal is present, the microcontroller 50 may use a sound qualification process similar to that shown in FIG. 5 and described below.

If no alert signal is detected within a timeout interval such as ten minutes, the microcontroller 50 flashes the red LED and causes the device 20 to output an error sound (block 80). The error sound may, for example, be a distinct alarm tone or pattern, or may be a pre-recorded or synthesized voice message explaining the error event (e.g., "No alarm was detected, please re-insert batteries and try again.") If an alert signal is detected, the microcontroller 50 iteratively programs/adjusts the adjustable threshold detector 42 to search for the threshold corresponding to the detected alert signal. As illustrated in block 82, a binary search algorithm may be used for this purpose. In block 84, once the threshold is detected, it is adjusted downward by an appropriate margin. This enables the supplemental alert generator 20 to detect subsequent occurrences of the alert signal that are slightly lower in volume (due to battery drain or other factors). In some embodiments, the microcontroller 50 may also output a pre-recorded or synthesized voice message indicating that the learning process was successful.

By adaptively adjusting the threshold in this manner, the initialization/learning process increases the likelihood that the supplemental alert generator 20 will remain in its low power "threshold monitoring" mode except when the adjacent detector/alert device 30 outputs an alert signal. This, in turn, increases the battery life of the supplemental alert generator 20, and reduces the likelihood of false positives.

As will be apparent, the learning process depicted by FIG. 3 can be omitted, or can be performed in response to some other triggering event (such as the depression of a button). In addition, as mentioned above, the process can be augmented to include other types of adjustments or calibrations that are based on an analysis of the timing and/or other parameters of the alert signal.

Once the initialization process is complete, the microcontroller 50 enters into its main program loop, which is illustrated in FIG. 4. This main loop corresponds to the low power "threshold monitoring" mode described above. As shown in blocks 90 and 92 of FIG. 4, the microcontroller 50 initially turns on the green LED for a preset duration and then checks the battery status. If the battery is low, a chirp sound is generated and the red LED is flashed (blocks 94 and 96). The microcontroller 50 then turns off the LEDs (block 98), sets its internal wake timer to 30 seconds (or another appropriate time period), and enters a low power sleep mode (block 100). The microcontroller 50 will typically spend the vast majority of its time (e.g., 99% or more) in this sleep state.

Figure 5:
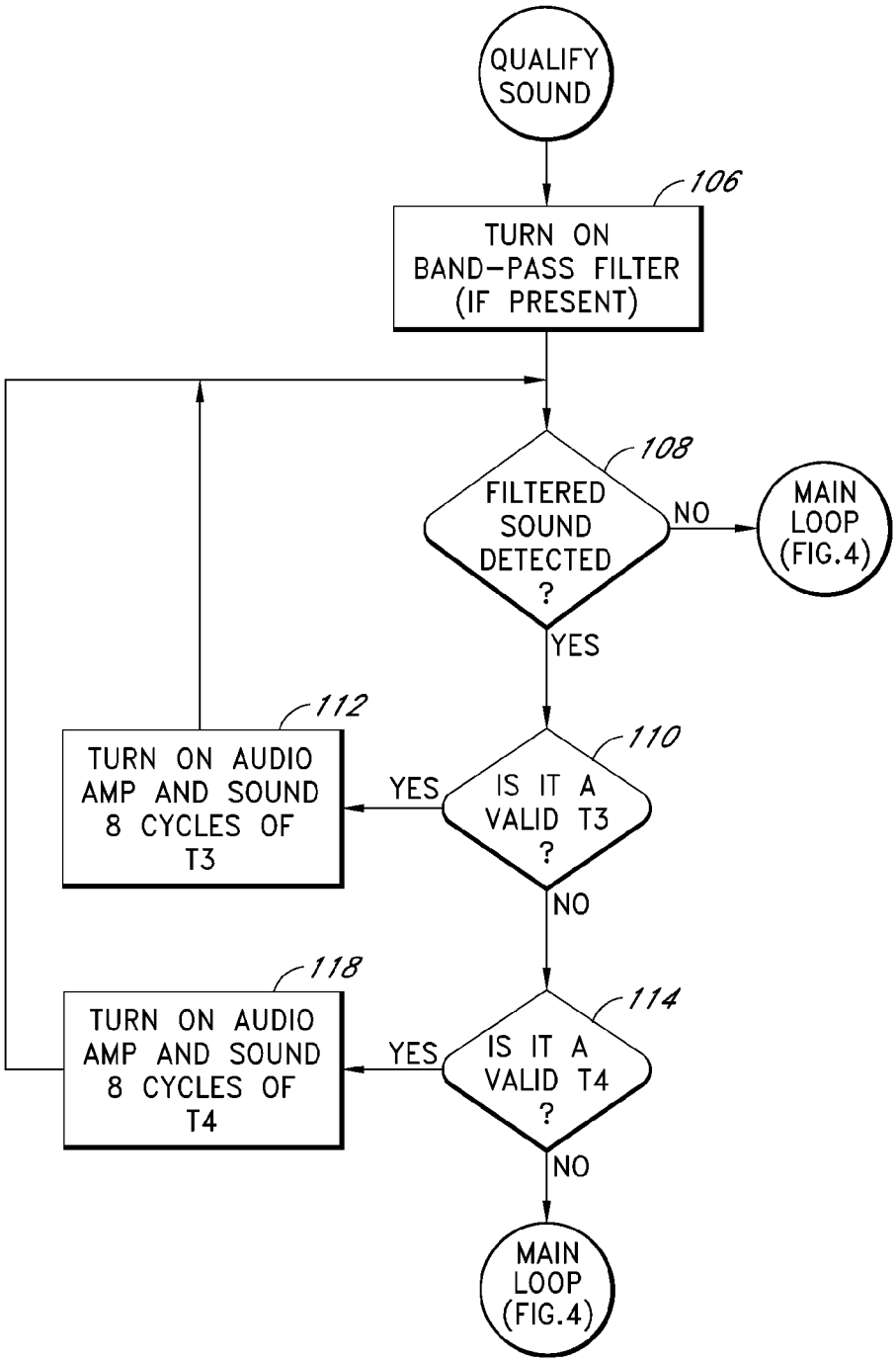
FIG. 5 illustrates a process executed by the supplemental alert generator's controller to assess whether a detected sound is a valid alarm, and for generating a supplemental alert/alarm if a valid alarm is detected.

As shown in block 102 of FIG. 4, three types of events can cause the microcontroller 50 to wake from its sleep mode in the illustrated embodiment: (1) the expiration of the wake timer, (2) the detection of a loud sound by the adjustable threshold detector 42, and (3) the depression of the supplemental alert generator's test button 24. If the wake timer expires, the steps represented by blocks 90-100 are simply repeated. If a loud sound is detected, the microcontroller 50 executes a sound qualification routine, which is depicted in FIG. 5 and discussed below. If the test button 24 is depressed, microcontroller 50, via the audio amplifier 54 and speaker 56, outputs an audible supplemental alert signal of the type generated when an alert condition is detected (block 104).

FIG. 5 illustrates one embodiment of a sound analysis/qualification routine that may be executed by the microcontroller 50 when a loud sound (one that meets or exceeds the threshold) is detected by the threshold detector 42. As shown in block 106, the microcontroller 50 initially powers up the band-pass filter 46 (block 106) if such a filter is provided, and then begins analyzing the output of the envelope detector 48 (block 108). This analysis may include or consist of (1) measuring the durations of any pulses and the amounts of time between consecutive pulses, and (2) determining whether these values correspond to a T3 or T4 pattern. As explained above, other types of patterns may also be supported, including patterns that are learned during the learning process. In embodiments in which the unfiltered output of the piezoelectric sensor 40 is fed to the microcontroller 50 (as described above), the microcontroller 50 may also determine the fundamental frequency of this signal, and determine whether this frequency falls within the frequency range of standard alert signals (e.g., 2800 Hz to 3500 Hz). Thus, the sound may be qualified based on its ON/OFF pattern (if any), and based additionally on its frequency during the "on" periods.

If a valid alarm signal is detected, the microcontroller 50 turns on the audio amplifier 54, and generates and outputs a supplemental alert signal for amplification by the audio amplifier (blocks 110-118). In the particular embodiment shown in FIG. 5, two patterns are supported: T3 and T4. If a T3 pattern is detected (block 110), the supplemental alert generator 20 outputs an audible supplemental alert signal having a T3 pattern (block 112). If a T4 pattern is detected (block 114), the supplemental alert generator 20 outputs an audible supplemental alert signal having a T4 pattern (block 118).

In one embodiment, the supplemental alert generator 20 outputs the supplemental alert signal in synchronization with the detected alert signal (preferably with the pulses or sounds of both signals synchronized in time). Thus, both devices 20 and 30 beep (or otherwise create a sound) at the same time, and both devices pause (create no sound) at the same time. As a result, the overall (combined) alarm sound level is increased during the beep or "on" periods without negating the silent periods. This increases the likelihood that the combined or retrofitted alert system will effectively alert the building's occupants. To implement the synchronization feature, the microcontroller 50 may, for example, begin outputting the first of eight cycles of a T3 (or T4) supplemental alert signal at the beginning of the next T3 (or T4) cycle of the monitored alert signal, and may then re-synchronize if the monitored alert signal is still present. The microcontroller 50 may alternatively adjust the timing of the output signal more frequently (e.g., once every T3 or T4 cycle) to maintain tighter synchronization, or less frequently to provide a lower degree of synchronization.

As explained above, any of a variety of sounds or tones can be used for the supplemental alert signal. For example, the supplemental alert signal can be a 520 Hz square wave, a square wave having a different frequency, a 520 Hz sinusoidal signal, a sweeping-frequency square wave or sinusoidal signal, or any other signal that may eventually be required by regulations. If or when new regulations are issued requiring a new alarm sound, a supplemental alert signal generator 20 designed to create the new alarm sound may be made available; this device 20 may then be used to retrofit an existing detection/alert system to comply with the new regulations. Existing facilities may similarly be retrofitted to add a strobe light alert signal or an RF transmission capability.

In some embodiments (and particularly those that use an audio speaker 56), the supplemental alert signal may include a prerecorded or synthesized voice message indicating the type of alarm detected (e.g., smoke versus carbon monoxide) and/or providing instructions (e.g., "please exit the building"). This message may be output at the end of a T3 or T4 cycle.

As illustrated in FIG. 5, if no filtered sound is detected or the filtered sound is not identified as a T3 or T4 pattern, the program returns to the main loop shown in FIG. 4.

IV. Adjustable Threshold Detector (FIG. 6)

FIG. 6 illustrates one embodiment of the adjustable threshold detector 42 shown in FIG. 2. The adjustable threshold detector 42 is shown connected to the piezoelectric sensor 40. Collectively, the adjustable threshold detector 42 and the piezoelectric sensor 40 form an adjustable threshold sound level detector. As mentioned above, the piezoelectric sensor 40 may, in some embodiments, be replaced with another type of device (such as a microphone) that converts sound into an electrical signal.

In the illustrated embodiment of FIG. 6, the adjustable threshold detector 42 includes a digital potentiometer 120 that operates in conjunction with a resistor R2 to form a voltage divider network. One example of a suitable digital potentiometer is the MAX5475 available from Maxim Integrated Products. The digital potentiometer 120 is controlled by the microcontroller 50 via three signal lines, which are labeled THRES_CS# (threshold chip select), THRES_INC# (threshold increment) and THRES_DIR (threshold direction), respectively. By adjusting the resistance setting of the digital potentiometer 120, the microcontroller 120 can adjust the voltage across the digital potentiometer 120, and thus the threshold used for sound detection. The adjustable threshold detector 42 also includes capacitors C1 and C2 and resistor RE which are used for filtering, and a push-pull output comparator 124. The component values shown in FIG. 6 are merely representative, and modifications to these values may be necessary or desirable.

In operation, the piezoelectric sensor 40 generates a small AC voltage in response to relatively loud sounds in the vicinity of its resonant frequency. When this AC voltage exceeds the voltage across the digital potentiometer 120, the (+) input of the comparator 124 becomes higher in voltage than the (−) input, causing the comparator 124 to flip its digital output. This digital output is provided to the microcontroller 50 (as shown by the WAKE signal line in FIG. 2), allowing the microcontroller to detect events in which the threshold is exceeded.

As will be apparent, the adjustable threshold detector 42 can be implemented in a variety of other ways. For example, rather than using a digital potentiometer, a digital-to-analog converter can be used to convert the output of the piezoelectric sensor 40 into a digital signal. This digital signal can be compared by the microcontroller 50 or another circuit to a threshold value to determine whether the sound threshold is reached.

V. Speaker Enclosure

Figure 7:
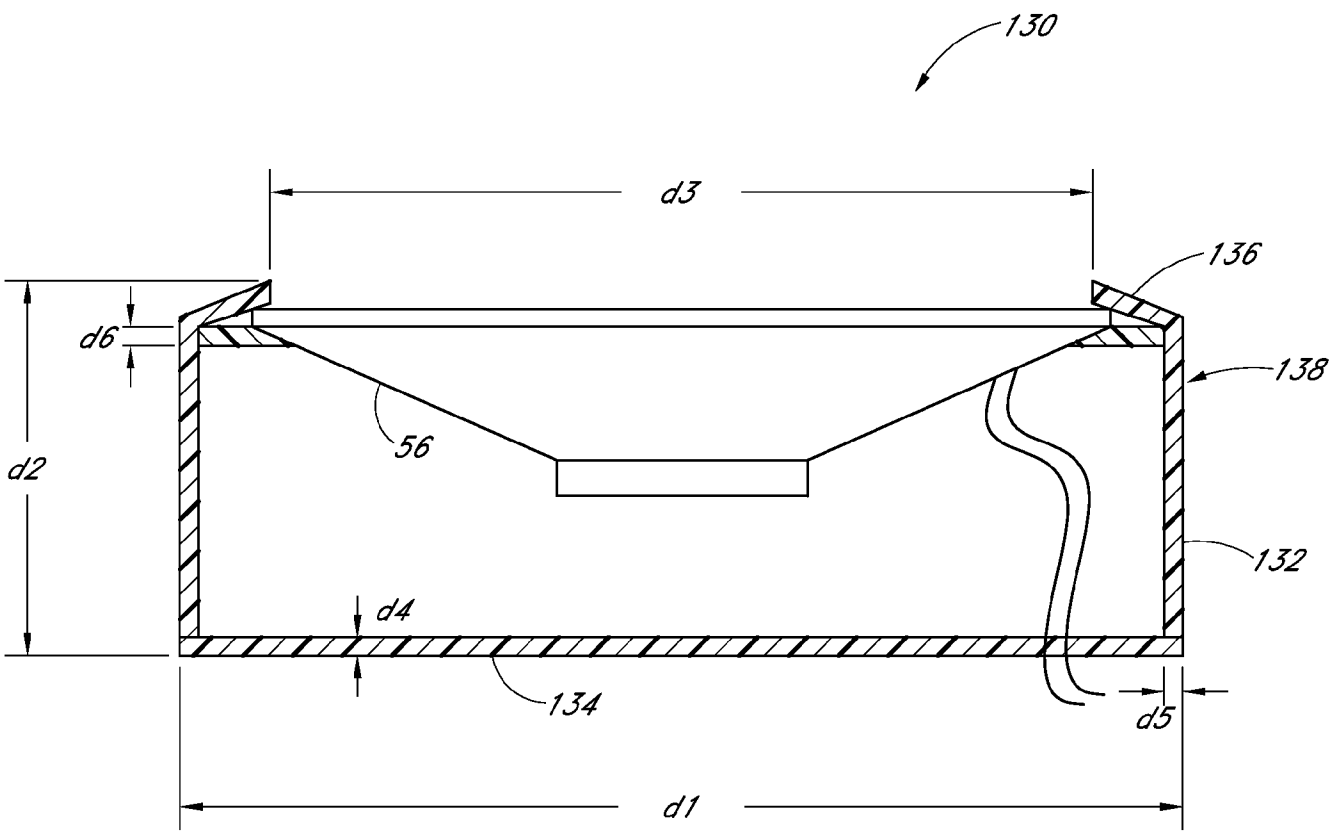
FIG. 7 is a cross sectional diagram of a speaker enclosure assembly that may be used to generate an audible supplemental alert signal.

FIG. 7 illustrates a speaker enclosure assembly 130 that may be used in some embodiments to improve the sound output of the audio speaker 56 at relatively low frequencies (e.g., 700 Hz or less). This and other suitable enclosure designs are disclosed in U.S. application Ser. No. 12/702,822, referenced above. The illustrated enclosure includes a tubular or cylindrical portion 138 that is capped or sealed by a circular back wall 134. In this implementation the speaker 56 is mounted at the opposite end of the tubular portion 138, and is held in place by a lip portion 136 and an internal bezel. The enclosure assembly may, but need not, be sealed. The enclosure assembly 130 may be partially or fully enclosed within the main housing (FIG. 1) of the supplemental alert generator 20, and is preferably oriented such that the speaker faces downward (toward the floor) when the supplemental alert generator 20 is mounted to the ceiling. The enclosure may be constructed from PVC (Polyvinyl chloride), sheet metal, or another suitable material.

In embodiments in which the supplemental alert signal is a square wave having a fundamental frequency in the range of 400 to 700 hertz, the enclosure assembly 130 is preferably tuned to have a primary or fundamental object resonance frequency that is approximately equal to the fundamental frequency of the square wave. For example, for a 520 Hz square wave, the speaker enclosure assembly 130 preferably has an object resonance of about 520 Hz, meaning that that speaker and enclosure combined collectively have a resonant frequency of about 520 Hz. This characteristic of the speaker enclosure assembly 130 advantageously causes some of the energy above about 2 or 3 kHz to be shifted down to the first (primarily), third and fifth harmonics. This, in turn, compensates for the relatively poor low-frequency performance of low-cost audio speakers 56 in the 1-inch to 3-inch range.

The object resonance of the speaker enclosure assembly can be adjusted by adjusting several mechanical variables, including, for example, the volume or diameter of the enclosure. The volume for producing a given object resonance will vary depending on various factors, including the mass and size of the speaker 56 and the type(s) of material used for the enclosure. Where a 3-inch speaker is used to produce an approximately 520 Hz square wave, an enclosure constructed of PVC plastic will typically have a wall 138 thickness of approximately 0.115 inch, a back wall 134 thickness of 0.100 inch, and a volume of 160 to 200 cubic centimeters. An enclosure constructed of sheet metal will typically have a side and back wall thickness of 0.010 inch, and a volume of 190 to 230 cubic centimeters. The side and back wall thicknesses, along with volume and diameter, can be used to manipulate the object resonance frequency of the speaker enclosure assembly. Typical dimensions and other parameters for a PVC implementation are shown in Table 1.

TABLE 1

| | |
|---|---|
| d1 (rear wall diameter) | Approximately 3.495 in. |
| d2 (enclosure length) | Approximately 1.450 in. |
| d3 (front wall opening diameter) | Approximately 2.765 in. |
| d4 (rear wall thickness) | Approximately 0.100 in. |
| d5 (side wall thickness) | Approximately 0.115 in. |
| d6 (bezel thickness) | Approximately 0.125 in. |
| Enclosure volume (w/o speaker) | Approximately 175 $cm^3$ |
| Speaker type | IDT, 2 W, 8 Ω |
| Speaker diameter | Approximately 3 in. |

VI. Conclusion

Various combinations of the above-described features and components are possible, and all such combinations are contemplated by this disclosure.

Conditional language, such as, among others terms, "can," "could," "might," or "may," and "preferably," unless specifically stated otherwise, or otherwise understood within the context as used, is generally intended to convey that certain embodiments include, while other embodiments do not include, certain features, elements and/or steps.

Many variations and modifications can be made to the above-described embodiments, the elements of which are to be understood as being among other acceptable examples. Thus, the foregoing description is not intended to limit the scope of protection.

What is claimed is:

1. A supplemental alert generation device for monitoring, and supplementing an audible alert generated by, a detector/alert device, the supplemental alert generation device comprising:

a piezoelectric sensor that passively converts sound into an electric signal;

a threshold detector connected to the piezoelectric sensor and operative to monitor the electrical signal, said threshold detector operative to generate a notification signal when the electrical signal exceeds a threshold level corresponding to a threshold sound level;

a controller programmed to respond to the notification signal by at least initiating a signal analysis process to assess whether an audio signal generated by the piezoelectric sensor represents an audible alert signal, said controller additionally programmed to initiate generation of a supplemental alert signal when the audible alert signal is detected, said supplemental alert signal having a fundamental frequency and a plurality of higher frequency harmonics, wherein the fundamental frequency is lower than a tone frequency of the audible alert signal and falls within a range of 400 to 700 hertz;

a speaker enclosure assembly that outputs the supplemental alert signal, said speaker enclosure assembly comprising an audio speaker mounted to a speaker enclosure structure, said speaker enclosure assembly having an object resonance in the range of 400 to 700 hertz, said speaker enclosure configured to produce a low frequency audible output boost at least partly by causing energy in at least one of the harmonics to be shifted downward in frequency, wherein the speaker enclosure assembly is sealed, such that the low frequency audible output boost is achieved without reliance on a Helmholtz effect; and a battery-powered amplifier that drives the audio speaker.

2. The supplemental alert generation device of claim 1, wherein the speaker enclosure structure is configured to shift energy to a first harmonic from at least one higher level harmonic.

3. The supplemental alert generation device of claim 1, wherein the fundamental frequency of the supplemental alert signal is approximately 520 hertz.

4. The supplemental alert generation device of claim 1, wherein the audio speaker is a three-inch audio speaker.

5. The supplemental alert generation device of claim 1, wherein the threshold detector is adjustable by the controller to vary a sound level at which said signal analysis process is initiated.

6. The supplemental alert generation device of claim 5, wherein the supplemental alert generation device is configured to implement a learn mode in which the controller adjusts the threshold detector based on a sound level of a detected audible alert signal.

7. The supplemental alert generation device of claim 6, wherein the supplemental alert generation device, when operating in said learn mode, is configured to output a voice message which instructs an operator to press a test button of the monitored detector/alert device.

8. The supplemental alert generation device of claim 5, wherein the threshold detector comprises a digital potentiometer that is adjustable by the controller to adjust said threshold level.

9. The supplemental alert generation device of claim 1, wherein the speaker enclosure assembly has a resonant frequency that corresponds to the fundamental frequency of the supplemental alert signal.

10. The supplemental alert generation device of claim 1, wherein the controller is additionally responsive to the notification signal by at least transitioning out of a sleep mode.

11. The supplemental alert generation device of claim 1, wherein the controller is responsive to the notification signal by at least determining whether the audio signal generated by the piezoelectric sensor has a pulse pattern corresponding to a pulse pattern used for audible alert signals.

12. The supplemental alert generation device of claim 1, wherein the threshold detector, the amplifier and the controller are powered exclusively by a set of one or more batteries.

13. The supplemental alert generation device of claim 1, further comprising a housing that houses the piezoelectric sensor, the threshold detector, the amplifier and the controller, and that at least partially houses the speaker enclosure assembly, said housing configured to be mounted to a ceiling.

14. The supplemental alert generation device of claim 1, wherein the supplemental alert signal is a square wave signal having a fundamental frequency between 400 and 700 hertz, and the speaker enclosure assembly outputs the supplemental alert signal at an average decibel level of 85 dBA or higher as measured at a distance of ten feet.

15. The supplemental alert generation device of claim 14, wherein the speaker enclosure assembly is configured to compensate for reduced low-frequency performance of the audio speaker by shifting energy from harmonics of the square wave signal downward to at least said fundamental frequency.

16. The supplemental alert generation device of claim 1, wherein the supplemental alert generation device is operative to generate an audible supplemental alert signal in response to detecting the audible alert signal having a temporal-three or a temporal-four pattern, and the controller is programmed to synchronize a pulse pattern of the audible supplemental alert signal in time with a pulse pattern of the temporal-three or temporal-four audible alert signal.

17. The supplemental alert generation device of claim 1, wherein the speaker enclosure structure has a speaker enclosure volume of 160 to 200 cubic centimeters.

18. The supplemental alert generation device of claim 1, wherein the speaker enclosure structure comprises a cylindrical tube that is capped at one end with a circular back wall, wherein the speaker is mounted at an opposite end of the cylindrical tube.

19. The supplemental alert generation device of claim 1, wherein the audio speaker has a diaphragm that is driven by a coil to produce sound waves corresponding to a received audio signal.

20. The supplemental alert generation device of claim 1, wherein the object resonance of the speaker enclosure assembly is dependent upon physical dimensions of the speaker enclosure structure.

21. The supplemental alert generation device of claim 20, wherein the object resonance of the speaker enclosure assembly is additionally dependent upon a mass and size of the audio speaker.

22. A method performed by a battery-powered supplemental alert generation device to detect an audible alert signal generated by a detector/alert device, the method comprising:

passively converting sound into an electrical signal using a piezoelectric sensor;

monitoring the electrical signal to determine whether a threshold sound level is met;

in response to determining that the threshold sound level is met, analyzing the electrical signal with signal processing circuitry to determine whether the electrical signal represents the audible alert signal, wherein analyzing the electrical signal comprises determining whether the electrical signal has a pulse pattern corresponding to a pulse pattern used for audible alert signals;

in response to determining that the electrical signal has a pulse pattern corresponding to a pulse pattern used for audible alert signals, outputting, to a speaker enclosure assembly that comprises an audio speaker mounted to a speaker enclosure structure, a supplemental alert signal having a fundamental frequency and a plurality of higher frequency harmonics, said fundamental frequency falling in the range of 400 to 700 hertz, said speaker enclosure assembly having an object resonance falling in the range of 400 to 700 hertz; and outputting an audible representation of the supplemental alert signal with the speaker enclosure assembly, wherein outputting the audible representation comprises producing a low frequency audio output boost at least partly by transferring energy in at least one of said harmonics downward in frequency, wherein the speaker enclosure assembly is sealed, such that the low frequency audio output boost is produced without reliance on a flow of as into or out of an enclosure chamber of the speaker enclosure assembly.

23. The method of claim 22, wherein the method is performed with the battery-powered supplemental alert generation device mounted to a ceiling less than three feet from the detector/alert device.

24. The method of claim 22, wherein the supplemental alert signal is substantially a square wave.

25. The method of claim 22, wherein the method comprises, with the speaker enclosure assembly, shifting energy from at least one harmonic of the alert signal to said fundamental frequency.

26. The method of claim 22, further comprising automatically selecting the threshold sound level based on an analysis of the audible alert signal, said analysis of the audible alert signal performed while the supplemental alert generation device is operating in a learning mode.

27. The method of claim 26, wherein automatically selecting the threshold sound level comprises determining a sound level of a detected audible alert signal, and setting the threshold sound level to a level that is a selected margin below the determined sound level.

28. The method of claim 22, wherein the supplemental alert signal has a temporal-3 pattern that is synchronized in time with a temporal-3 pattern of a detected audible alert signal.

29. The method of claim 22, wherein the supplemental alert signal has a temporal-4 pattern that is synchronized in time with a temporal-4 pattern of the detected audible alert signal.

30. The method of claim 22, wherein the amplifier is a boosted Class D amplifier.

31. The method of claim 22, wherein the supplemental alert signal is a square wave signal having a fundamental frequency of about 520 hertz, and the speaker enclosure assembly has a resonant frequency of about 520 hertz.

32. The method of claim 22, wherein analyzing the electrical signal with signal processing circuitry comprises assessing both (1) whether the electrical signal has a temporal-three pulse pattern, and (2) whether the electrical signal has a temporal-four pulse pattern, and wherein the method further comprises:

when the electrical signal is determined to have a temporal-three pulse pattern, outputting the audible supplemental alert signal with a temporal-three pulse pattern that is synchronized in time with the temporal-three pulse pattern of the electrical signal; and when the electrical signal is determined to have a temporal-four pulse pattern, outputting the audible supplemental alert signal with a temporal-four pulse pattern that is synchronized in time with the temporal-four pulse pattern of the electrical signal.

33. The method of claim 22, wherein the audible representation of the supplemental alert signal has an average decibel level of 85 dBA or higher as measured at a distance of ten feet from the supplemental alert generation device.

34. The method of claim 22, wherein the audio speaker has a diaphragm that is driven by a coil to produce sound waves corresponding to a received audio signal.

35. The method of claim 22, wherein the object resonance of the speaker enclosure assembly is dependent upon physical dimensions of the speaker enclosure structure.

36. A supplemental alert generation device comprising:

a speaker enclosure assembly comprising an audio speaker mounted to a speaker enclosure structure, said audio speaker comprising a diaphragm that is driven by a coil to produce sound waves corresponding to a received audio signal, said speaker enclosure assembly having an object resonance in the range of 400 to 700 hertz, said object resonance being dependent upon physical dimensions of the speaker enclosure structure; and processing circuitry that is configured to detect an audible alert signal generated by a detector/alert device, and to respond to the audible alert signal by driving the audio speaker with a supplemental alert audio signal having a fundamental frequency and multiple harmonic frequencies, said fundamental frequency falling in the range of 400 to 700 hertz;

said speaker enclosure assembly configured to cause energy in the supplemental alert audio signal to be transferred downward in frequency from at least one of the harmonic frequencies, wherein the speaker enclosure assembly is sealed, such that the transfer of energy occurs without reliance on a Helmholtz effect.

37. The supplemental alert generation device of claim 36, wherein the supplemental alert audio signal has a fundamental frequency of approximately 520 Hz.

38. The supplemental alert generation device of claim 37, wherein the object resonance of the speaker enclosure assembly is approximately 520 Hz.

39. The supplemental alert generation device of claim 37, wherein the audio speaker has a diameter of approximately 3 inches.

40. The supplemental alert generation device of claim 36, wherein the speaker enclosure assembly is configured to transfer energy from at least one of the harmonic frequencies to the fundamental frequency.

41. The supplemental alert generation device of claim 36, wherein the speaker enclosure structure comprises a tubular section that is capped at one end, and wherein the audio speaker is mounted at an opposite end of the tubular section.

42. The supplemental alert generation device of claim 41, wherein the speaker enclosure structure comprises plastic enclosure walls.

43. The supplemental alert generation device of claim 36, wherein the processing circuitry comprises a boosted class D amplifier coupled to a programmed controller.

44. The supplemental alert generation device of claim 36, wherein the supplemental alert audio signal is a square wave signal.

* * * * *